United States Patent [19]

Blanchard

[11] Patent Number: 4,600,132

[45] Date of Patent: Jul. 15, 1986

[54] ADJUSTABLE HANGER

[75] Inventor: Russell O. Blanchard, Zeeland, Mich.

[73] Assignee: John Thomas Batts, Inc., Zeeland, Mich.

[21] Appl. No.: 726,613

[22] Filed: Apr. 24, 1985

[51] Int. Cl.[4] ..... A47G 25/30

[52] U.S. Cl. ..... 223/95

[58] Field of Search ..... 223/95, 85, 87, 88, 223/92, 96; D6/315–328

[56] References Cited

U.S. PATENT DOCUMENTS

| | | | |
|---|---|---|---|
| D. 259,979 | 7/1981 | Hazenveld . | |
| 773,583 | 11/1904 | Nagely | 223/85 |
| 930,407 | 8/1909 | Nagely | 223/88 |
| 3,411,679 | 11/1968 | Rooz | 223/95 |
| 3,460,726 | 8/1969 | Rooz | 223/95 |
| 4,221,310 | 9/1980 | Hazenveld | 223/94 |
| 4,223,817 | 9/1980 | Hazenveld | 223/94 |

FOREIGN PATENT DOCUMENTS

| | | | |
|---|---|---|---|
| 229133 | 6/1960 | Australia | 223/85 |
| 1514978 | 6/1978 | United Kingdom | 223/96 |

*Primary Examiner*—Louis K. Rimrodt
*Assistant Examiner*—Joseph S. Machuga
*Attorney, Agent, or Firm*—Price, Heneveld, Huizenga & Cooper

[57] ABSTRACT

A garment hanger having flexibly hinged support arms to which an upper pair of lever arms are secured. The lever arms and support arms both include a medial hinge that provide for the upward pivoting of the support arms when the lever arms are converged. An elongated, resilient biasing rod is secured between the support arms in order to bias the support arms to a generally planar configuration and thereby tension the support arm outer ends against the garment. The lever arms include gripping segments that are oriented and spaced in order to permit the gripping segments to be grasped and squeezed in one hand in order to converge the support arm outer ends.

20 Claims, 11 Drawing Figures

ADJUSTABLE HANGER

BACKGROUND OF THE INVENTION

The present invention relates to garment hangers, and in particular to garment hangers that are used for the transportation and/or retail display of garments.

A wide variety of hangers have been designed for the support of pants, skirts and the like. One general class or type of such garment hangers is that which includes a clamp or grasping mechanism that positively secures the garment to the hanger body. Although such clamping mechanisms operate satisfactorily to secure the garment to the hanger, one problem associated with these hangers is the time required to secure the garment. Although the securing time per garment may not in itself be lengthy, for wholesale manufacturers or the like even minor excesses in per garment handling results in excessive costs. Another problem associated with such clamp hangers is the marking or creasing of the garment which results from a clamp element grasping or engaging the exterior of the garment. Such markings reduce the aesthetics of the garment for retail and are therefore highly undesirable. Pressing or otherwise removing these markings from each garment prior to retail is cost prohibitive.

Another class of garment hangers used in the supporting of pants, skirts and the like are those which are secured to the inside of the garment. Such hangers normally include at least two garment engaging surfaces, and some type of mechanism for spreading or separating these engagement surfaces. The garment is secured to the hanger by converging the engagement surfaces, inserting the hanger within the waistband of the garment and then separating these surfaces to engage and tension the waistband. Such hangers avoid the problem of exterior markings on the garment.

A problem associated with such internal expanding hangers is that of the degree of support provided. Since there is no positive clamp element such hangers do not provide as secure a support as the clamping variety noted above. Certain internally engaging hangers therefore do not provide sufficient support to withstand the jolting and jarring to which a suspended garment is subjected during transport from the manufacturer. Further, since the garment is secured to the hanger through the tension applied by the engagement surfaces, the separating or tensioning mechanism is usually relatively complex. The manufacture of such complex hanger designs is both time consuming and expensive.

In an attempt to resolve some of the problems noted above, one type of garment hanger employs a pair of tensioning arms that are hinged to pivot their outer ends divergently downwardly. Garment securing clamps are carried on the tensioning arm outer ends. A pair of connecting arms are hingedly joined to the tensioning arms and provide an anchoring location for the support hook. Due to this hanger configuration, the garment mounting outer ends do not vary substantially in a vertical relation to the hook as the outer ends are converged and diverged. This provides a pleasing uniform appearance of the garments when hung by such hangers on a garment rack. Further, since the tensioning arms pivot downwardly to diverge, any downward force exerted on the garment, such as occurs due to jarring during transport, operates to diverge and increase the grip applied by the garment securing clamps.

Although such a hanger reduces some of the problems noted above, hangers of this type still exhibit the marking problems associated with external securing clamps. Since most of the tension applied by the hanger simply results from the inherent resiliency of the hanger material, secure support may not be supplied by the relatively minimal lateral forces generated by the plastic interconnection of the tensioning arms and connecting arms. Further, the tensioning arms of such hanger are not conveniently converged or retracted, and may require the use of two hands for the hanger alone. This both complicates and slows the garment hanging process.

SUMMARY OF THE INVENTION

The present invention resolves the problems noted above by the provision of a garment hanger having a pair of support arms that pivot upwardly to converge or retract the garment engaging outer ends for insertion into the garment. A pair of lever arms are hingedly interconnected and have distal ends that are secured to the support arms. The support arms are secured to a resilient biasing element that biases the support arms toward a common plane in order to thereby diverge the garment engaging ends. Additionally, the lever arms include gripping segments that are oriented and positioned sufficiently proximate each other to permit the gripping segments to be grasped and converged in one hand. A pair of securing clips may be detachably clipped onto the garment engaging outer ends of the hanger for use as lower stop members with relatively heavy garments. The biasing element is a resilient, metal rod snap-fitted into the medial region of the molded plastic hanger body.

It will be noted that with the above garment hanger, secure support is provided to the garment through the resilient tensioning which results from the biasing element. The provision of the resilient biasing element permits lightweight to average weight garments to be hung from the hanger without requiring the use of external clamps or the like.

Further, the provision of gripping segments on the lever arms provides the hanger with one handed operation for securing the garment to the hanger. One handed operation of the hanger greatly reduces the time required for the hanging process. Additionally, the hanger itself is relatively lightweight and uncomplicated in manufacture. Due to the molded plastic construction and ease of assemblying the biasing rod onto the hanger body, the cost of mass producing the garment hanger is relatively low.

These and other features, advantages and objects of the invention will be appreciated by one skilled in the art from the specification, claims and drawings appended hereto.

DETAILED DESCRIPTION OF THE PREFERRED EMBODIMENT

Figure 1:
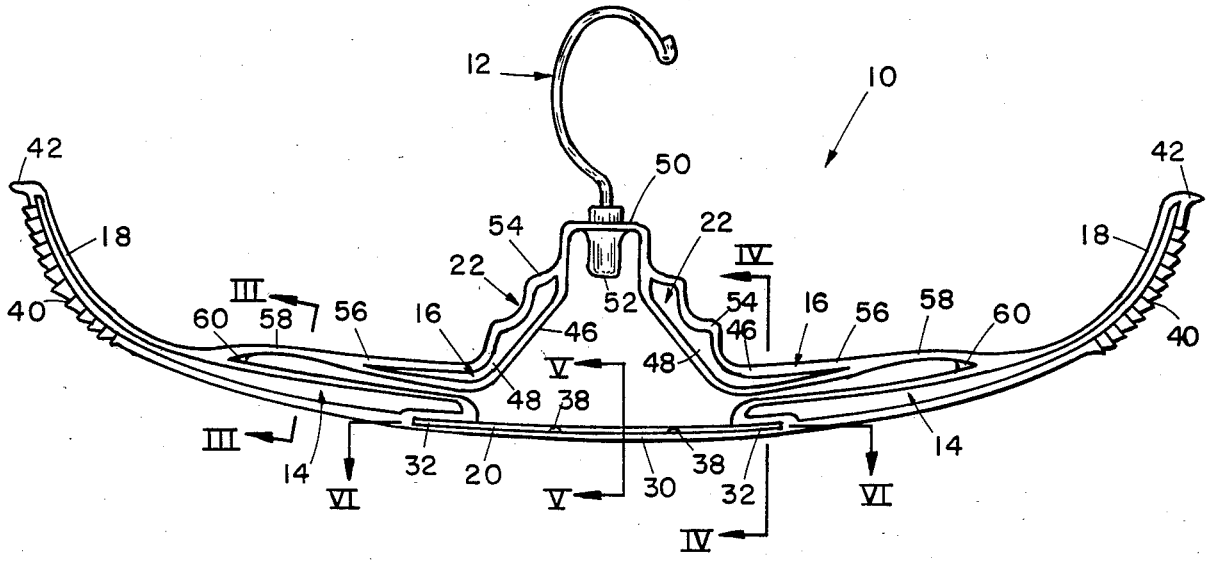
FIG. 1 is a front elevational view of a garment hanger embodying the present invention, shown in a stabilized condition.

The invention in its preferred embodiment is shown in FIG. 1 as an adjustable garment hanger referenced generally by the numeral 10. Hanger 10 includes a support hook 12 secured to the hanger body that includes an integrally molded pair of opposed support arms 14 and a pair of lever arms 16. Support arms 14 each terminate in a garment engaging outer end 18 that fit within and engage against the waistband of the garment to be hung. A resilient biasing spring or rod 20 is snap-fitted onto the medial portion of hanger 10 between support arms 14 and provides a resilient hinge that biases support arms 14 toward a generally planar condition. Lever arms 16 include gripping segments 22 which are hingedly joined and spaced to permit both gripping segments 22 to be grasped in one hand.

When gripping segments 22 are grasped and converged, support arms 14 are pivoted upwardly relative to metal rod 20 and outer ends 18 are thereby converged or retracted. Hanger 10 is then fitted within the waistband of the garment to be hung, and upon release of the gripping segments 22 metal rod 20 biases outer ends 18 outwardly to engage the garment waistband. Metal rod 20 maintains tension against the garment and provides a secure support that maintains the garment thereon even though jolted or jarred.

Figure 2:
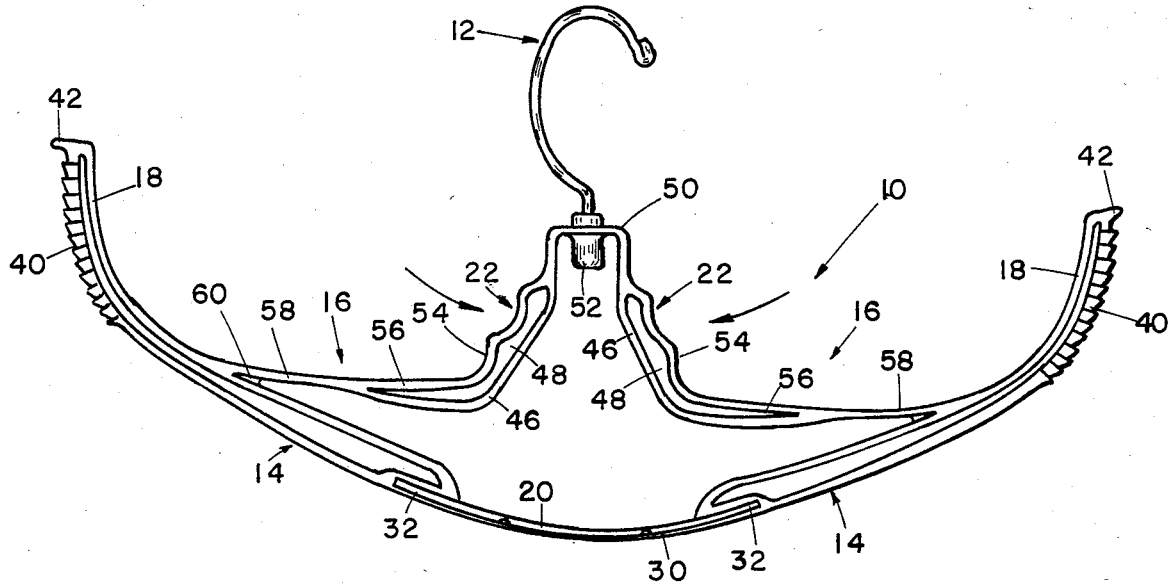
FIG. 2 is a front elevational view of the garment hanger shown in FIG. 1, shown in a converged condition as a result of pressure applied to the gripping segments of the hanger.
Figure 3:
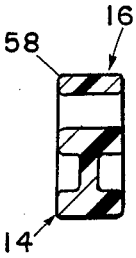
FIG. 3 is a sectional elevational view taken along plane III—III of FIG. 1.
Figure 4:
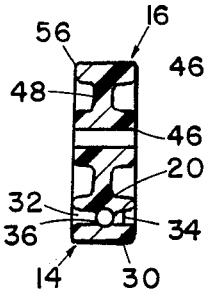
FIG. 4 is a sectional elevational view taken along plane IV—IV of FIG. 1.
Figure 5:
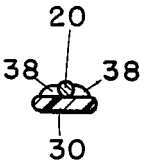
FIG. 5 is a sectional elevational view taken along plane V—V of FIG. 1 at the base portion of the hanger body.
Figure 7:
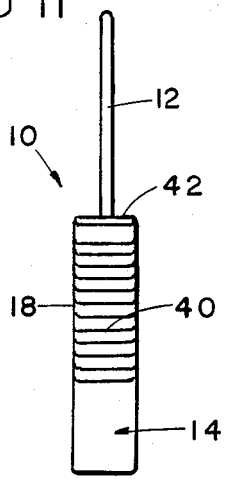
FIG. 7 is an end elevational view of the hanger shown in FIG. 1.
Figure 6:
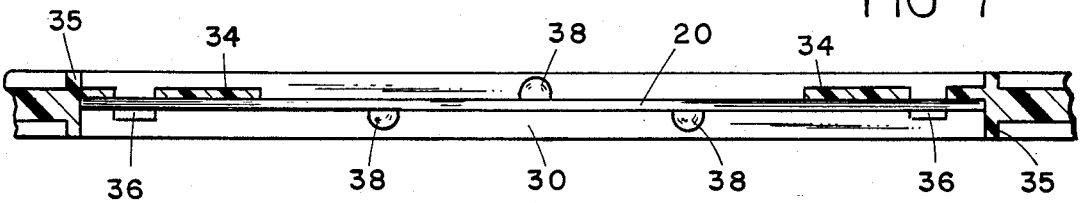
FIG. 6 is a fragmentary, sectional plan view taken along plane VI—VI of FIG. 1.

As shown in FIGS. 1–3, each support arm 14 has a molded I-beam construction with a raised perimeter so that each support arm is a rigid member. Support arms 14 are joined by an integrally molded flexible web 30 that provides a flexible hinge in the medial portion of hanger 10. As shown in FIGS. 1 and 4, at each end of resilient web 30 is a rod receiving pocket 32 that extends into its adjacent support arms 14. Pocket 32 has a rear wall 34 (FIG. 6) and end wall 35 that form a closure from the rear. A pair of raised lands 36 (FIG. 4) converge toward each other from the top and bottom of pocket 32 in order to form a snap-fitted closure from the front of pocket 32. During assembly the ends of rod 20 are simply snapped into pocket 32 past lands 36. The space defined between the ends of pockets 32 may be slightly greater than the length of rod 20 in order to provide for the stress distortion resulting from the flexing of web 30, and also to provide clearance while rod 20 is inserted therein. Spaced along the upper surface of web 30 are three raised lands 38 (FIGS. 5, 6) that define a channel along which rod 20 is received. Lands 38 position rod 20 and prevent rod 20 from bowing laterally during flexure of web 30. Rod 20 is an elongated, spring steel rod or bar that extends a substantial distance along web 30. Rod 20 curves smoothly when flexed in order to distribute the flexing or hinged pivoting between support arms 14 along the length of web 30. Rod 20 therefore prevents the concentrated bending and fatigue of web 30 in a narrow junction area intermediate support arms 14, as well as providing a biasing spring force that operates along a substantial length along web 30 between support arms 14.

Garment engaging outer ends 18 on support arms 14 curve smoothly upwardly in order to provide hanger 10 with a generally upwardly concave configuration. This upward curvature of outer ends 18 provides support arms 14 with a generally vertical surface for contact with the garment regardless of the angle of attitude assumed by the support arms 14. The outer surfaces of outer ends 18 each have a saw-toothed, serrated surface 40, with the hooking ends of the serrations facing upwardly. The serrations 40 provide high friction engaging surfaces that contact the inner surface of the garment in order to resist downward slip of the garment material. At the terminal end of each outer end 18 is an outwardly projecting upper stop flange 42. Upper stop flange 42 provides an abutment surface for contacting the top of the garment in order to provide an indexing point for rapid insertion of hanger 10 into the garment waistband.

Lever arms 16 are integrally molded with support arms 14. Lever arms 16 also have a general I-beam construction (FIG. 4) formed by a raised perimeter 46 with a joining web 48. The I-beam construction of lever arms 16 causes arms 16 to be substantially rigid, and prevents bowing or flexing of gripping segments or handles 22 when converged, as described in detail below. The handle portion of the lever arms 16 are interconnected by a planar web that forms a bifurcating hinge 50. Since hinge 50 is formed from a planar web, rigid gripping segments 22 pivot readily about hinge 50. Extending through hinge 50 is an upwardly opening hanger socket 52 that receives support hook 12 in a conventional manner. Support hook 12 provides a means for support for said support arms 14 and is retained within socket 52 in a known manner permitting rotation, such as by an annular crimping or flutting of the lower end. The resiliency of the socket material permits the crimped end to be received and retained in socket 52. Hook 12 may alternatively be an integral plastic hook, a detachable support ring, or other conventional support mechanisms.

On the outwardly opposed faces or surfaces of gripping segments 22 are scalloped grip surfaces 54 that cooperate to form a handle or grip which accommodates a person's fingers. Scalloped grip surfaces 54 are formed from that portion of raised perimeter 46 along the outer edge of gripping segments 22. Gripping segments 22 are both oriented and spaced in order to permit both gripping segments 22 to be grasped in one hand. As noted above the I-beam construction of gripping segments 22 cause segments 22 to be rigid. Exemplary of preferred dimensions that accommodate such one-handed gripping are a hinge 50 which spaces the upper ends of gripping flanges 22 approximately $1\frac{1}{4}$ inch, and gripping segments 22 which form an angle of divergence ranging between approximately 75 and 80 degrees. Each gripping segment 22 has a preferred overall length of approximately 3 inches, so that the lower ends of gripping segments 22 are spaced approximately 4 inches apart.

Extending from the lower ends of gripping segments 22 are outwardly extending segments 56 of lever arms 16. Outward extending segments 56 have the same I-beam construction formed by perimeter 46 and interior web 48. Outward segments 56 are therefore substantially rigid and move with the corresponding gripping segments 22. Outward segments 56 therefore do not bow or otherwise deform when gripping segments 22 are converged as explained below. Outward segments 56 extend roughly parallel to support arms 14, and lever arms 16 and are joined at their distal ends to support arms 14. Segments 56 are each joined to the support arm 14 by a horizontal web 58 that forms a hinge between lever arm 16 and support arm 14. Web 58 is a relatively long web section spanning between support arms 14 and lever arms 16. This long web section provides a living hinge in which deformation or stress is spread over a substantial area, rather than being concentrated in a short section immediately adjacent support arms 14. The juncture between support arms 14 and lever arms 16 are reinforced by gussets 60 so as to be rigid in this immediate area. Gussets 60 both transfer the stress and deformation to the long area provided by web 58, and prevent fracturing or separation of the plastic material in the high stress juncture region between support arms 14 and lever arms 16. Webs 58 curve upward slightly from support arms 14, to provide a bowed spacing between support arms 14 and lever arms 16. Outwardly extending segments 56 are approximately each 4 inches long, and therefore the distal ends of lever arms 16 each join support arms approximately 6 inches from the bifurcating plane of hanger 10. As shown in FIG. 2, due to the provision of outwardly extending segments 56, the squeezing of gripping segments 22 causes the distal ends of lever arms 16 to be drawn inward, thereby converging outer ends 18 as described more fully below. It will be recognized from the preceding description that the structure from the base of the handles outwardly to the arms is a tension member the inner portion of which is rigid and the outer portion flexible.

Figure 8:
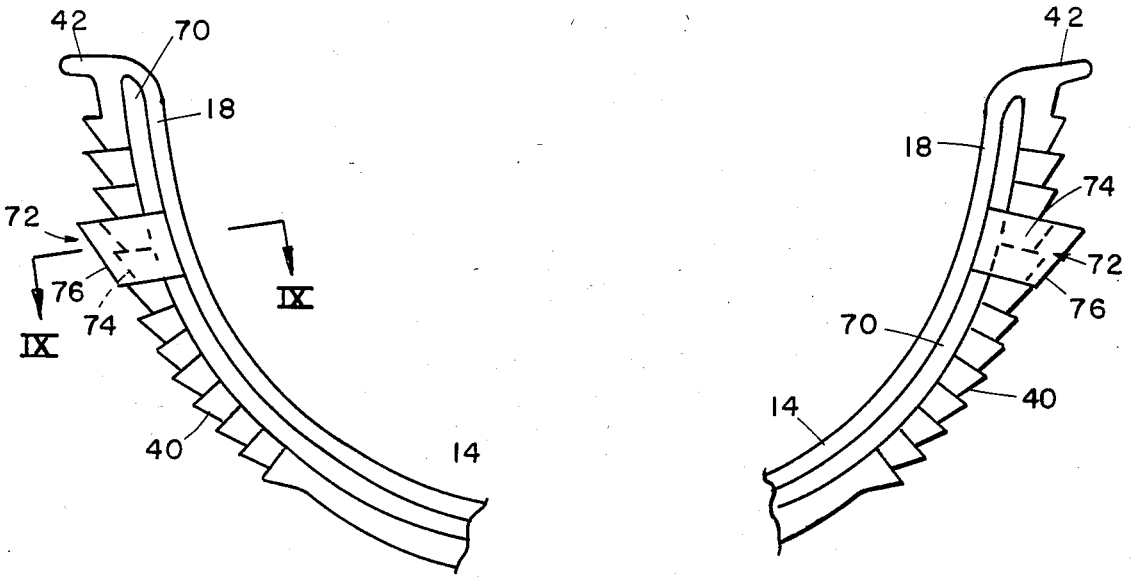
FIG. 8 is a fragmentary, front elevational view of the hanger of FIG. 1, showing removable garment securing clips attached to the outer ends thereof.
Figure 9:
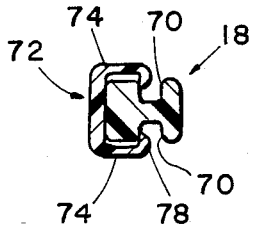
FIG. 9 is a sectional plan view taken along plane IX—IX of FIG. 8.
Figure 10:
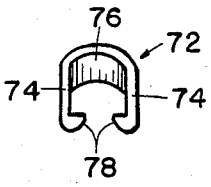
FIG. 10 is a top plan view of a removable garment securing clip shown in FIG. 8.
Figure 11:
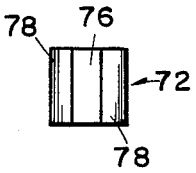
FIG. 11 is an end elevational view of the garment securing clip of FIG. 10.

As shown in FIGS. 8 and 9, the I-beam construction of support arms 18 provides a recessed channel 70 along either side of outer ends 18. In a modified hanger structure shown in FIGS. 8 and 9, a pair of supplemental garment securing clips 72 are detachably secured to outer ends 18. Clips 72 each form a protruding lower stop surface that will engage beneath the garment's waistband and prevents its separation from the hanger. Clips 72 are molded plastic and have an overall U-configuration. Clips 72 each include side legs 74 that are joined by an angled end wall 76. As best seen in FIG. 8, end wall 76 angles upwardly and outwardly in order to accommodate the teeth of serrations 40. The angle of end wall 76 also causes the lower surface of clip 72 to abut or sit on the upper surface of a serration 40. This abutment holds clip 72 in position and prevents clip 72 from sliding down outer end 18 due to the weight of a suspended garment. Converging along the free ends of sidewalls 74 are inwardly extending lips 78. Lips 78 are received in channels 70 (FIG. 9) in order to secure clips 72 to outer ends 18. Since clips 72 are made from molded plastic, lips 78 may be forced around the outer surface of ends 18 with sidewalls 74 resiliently separating to permit clips 72 to be snapped onto hanger 10.

In use, a garment is secured to hanger 10 with the waistband or the like passing around serrated surfaces 40. Clips 72 when used are snapped over the serrated surface in a position to seat under the garment's waistband. Their spacing from the upper stop flange 42 is adjusted to accommodate the waistband width of the garment. The clips 72 are particularly useful for securing heavy garments to hanger 10, such as garments made of denim, wool or the like. As will be recognized, hanger 10 is readily usable either with or without clips 72, depending upon the weight of the garment to be suspended.

In order to secure a garment to hanger 10, hanger 10 is grasped with both gripping segments 22 in one hand. Gripping segments 22 are compressed in order to flex about interconnecting hinge 50 as shown in FIG. 2. Since segments 22 are rigid, segments 22 pivot about hinge 50 without bowing or flexing along their length. This rigid pivoting of gripping segments 22 cause outwardly extending segments 56 to be drawn inward and flex about webs 58, causing support arms 14 to flex upwardly about webs 30. Outwardly extending segments 56 are generally aligned with the lower edge of outer ends 18. At least in part due to this alignment, the point of upward pull on outer ends 18 is adjacent and aligned with the bottom of lower ends 18, so that the squeezing of gripping segments 22 results in the downward arching of web 30 during this pivot action. The downward arching of web 30 results in the vertical relationship between outer ends 18 and hook 12 not varying substantially while outer ends 18 converge. Hanger 10 is inserted in the waistband of the garment and gripping segments 22 are released. Rod 20 biases support arms 14 toward a stabilized, generally planar condition shown in FIG. 1 and therefore urges garment engaging outer ends 18 outwardly. Rod 20 tensions outer ends 18 against the garment and maintains the garment thereon. It will be noted that since outer ends 18 converge upwardly and diverge downwardly, the weight of the garment hanging on hanger 10 causes outer ends 18 to diverge and maintain the garment thereon.

It is to be understood that the above is merely a description of the preferred embodiment, and one skilled in the art will recognize various modifications and improvements that may be made without departing from the spirit of the invention disclosed herein. The scope of the protection afforded is to be determined by the claims which follow and the breadth of interpretation that the law allows.

The embodiments of the invention in which an exclusive property or privilege is claimed are as follows:

1. A garment hanger, comprising:

a pair of opposed support arms having garment engaging outer ends;

means joining said support arms connected with and extending between the inner ends of said support arms;

a pair of interconnected lever arms above said support arms and having distal ends pivotally secured to said support arms, said lever arms being rigid over a substantial portion thereof and having a hinged interconnection to each other adjacent the center of the hanger to provide said distal ends with the ability to be converged and diverged; and said joining means including an elongated resilient spring element in the medial area between said support arms, and cooperating with said hinged interconnection to permit said support arms to pivot upwardly and converge said garment engaging outer ends, said spring element biasing said garment engaging outer ends to diverge and, said support arms to shift outwardly and toward an opposed planar position, each of said lever arms having an upwardly extending segment adjacent said hinged interconnection, said segments being adjacent each other to form an upwardly extending grip whereby said garment engaging outer ends can be converged for insertion within a garment and said spring element will bias said garment engaging outer ends into engagement with the garment for support thereof upon release of the grip.

2. The garment hanger of claim 1, wherein:

said resilient spring element is a metal rod.

3. The garment hanger of claim 2, wherein:

said support arms are made of molded plastic material, each support arm having a rod receiving pocket molded therein, said pockets having means for securing the ends of said metal rod therein, said securing means providing said rod with the ability to be inserted into said pockets after the molding of said support arms.

4. The garment hanger of claim 3, wherein:

said rod securing means includes at least one raised land at said pockets, providing said rod with the ability to be snapped into said pockets past said land.

5. The garment hanger of claim 2, wherein:

said support arms are molded plastic material and said joining means includes a flexible medial section integral with said support arms, said metal rod extending along said flexible medial section, means on said medial section for securing said rod thereto.

6. The garment hanger of claim 1, further comprising:

a pair of removable, generally "U" shaped securing clips; and said support arms each having a clip recess on said garment engaging outer end, one of said clips being clipped onto each said garment engaging outer end and received in said clip recess.

7. The garment hanger of claim 1, wherein:

said gripping segments are sufficiently proximate to each other to permit said gripping segments to be grasped and converged in a single hand.

8. The garment hanger of claim 7, wherein:

said lever arms include outwardly extending segments disposed between said gripping segments and said distal ends, said outwardly extending segments forming an angle therebetween greater than the angle formed by said gripping segments.

9. The garment hanger of claim 8, wherein:

said outwardly extending segments being joined to said support arms by elongated webs forming flexible living hinges, said elongated webs hingedly flexing along a substantial length thereof.

10. The garment hanger of claim 9, wherein:

said elongated webs space said outwardly extending segments vertically from said support arms.

11. A garment hanger, comprising:

a pair of opposed support arms having garment engaging outer ends and a central portion joining said support arms;

a pair of lever arms having adjacent ends and distal ends;

hinged means for pivotally connecting the adjacent ends of said lever arms adjacent the center of said hanger;

means for support of said support arms and lever arms connected at said hinged means;

said distal ends of said lever arms being pivotally connected to said support arms at points adjacent said outer ends;

the portions of said lever arms adjacent said hinged means diverging downwardly from said hinged means to form a grip and being rigid whereby as said portions are converged toward each other the distal ends of said support arms are contracted toward each other;

an elongated resiliently flexible web member forming the central portion joining said support arms; and an elongated resilient biasing element secured to said web member for holding the distal ends of said arms in a substantially maximum divergent position when the hanger is uncontracted and in stabilized condition.

12. The garment hanger of claim 11, wherein:

said lever arms include outwardly extending segments disposed between said grip and said distal ends, said outwardly extending segments extend generally parallel to said support arms.

13. The garment hanger of claim 11, wherein:

said lever arms are connected to said support arms by resiliently flexible webs, said resiliently flexible webs spacing said lever arms above said support arms to form a gap therebetween.

14. The garment hanger of claim 11, further comprising:

a pair of removable, generally "U" shaped securing clips; and said support arms each having a clip recess on said garment engaging outer end, one of said clips being clipped onto each said garment engaging outer end and received in said clip recess.

15. The garment hanger of claim 11, wherein:

said garment engaging ends are upwardly curved and have a serrated engagement surface thereon.

16. The garment hanger of claim 11, wherein:

said support arms and said lever arms are integrally molded from a plastic material, said biasing means including a resilient metal rod secured between said support arms.

17. A molded plastic garment hanger having a pair of spaced oppositely extending upwardly curved generally rigid arms and an integral elongated web portion joining said arms, the ends of said arms having outwardly facing garment engaging and gripping means; a grip element above said web portion and centered between the ends of said arms, said grip element having a pair of rigid downwardly divergent handles hingedly connected at their upper ends; a pair of tension members connected to the lower ends of said handles and hingedly connected to said arms at points spaced substantially outwardly from the outer ends of said web; the inner portions of said tension members being rigid; an elongated resilient element secured to and extending the length of said web urging said web into a shallow concave configuration and said arms outwardly.

18. The garment hanger defined in claim 17 wherein the resilient element is a rod seated against the upper surface of said web; a plurality of lands engaging and securing the rod.

19. The garment hanger defined in claim 18 wherein said handles, in released position are spaced such that they can be held in one hand; the outer surfaces of said handles being scalloped to provide finger seats.

20. The garment hanger defined in claim 19 wherein said rod when said hanger is unloaded has a shallow concave configuration.

* * * * *